US005720353A

United States Patent [19]

Wilkening

[11] Patent Number: 5,720,353

[45] Date of Patent: Feb. 24, 1998

[54] APPARATUS AND METHOD FOR COUPLING A BLADE ASSEMBLY TO A VEHICLE

[75] Inventor: Kevin J. Wilkening, Peoria, Ill.

[73] Assignee: Caterpillar Inc., Peoria, Ill.

[21] Appl. No.: 759,909

[22] Filed: Dec. 4, 1996

[51] Int. Cl.[6] ..... E02F 3/76

[52] U.S. Cl. ..... 172/795; 172/781; 172/747

[58] Field of Search ..... 172/742, 747, 172/781, 791, 792, 793, 795, 796, 797, 805; 414/66, 67, 68, 69

[56] References Cited

U.S. PATENT DOCUMENTS

| | | | |
|---|---|---|---|
| 3,463,243 | 8/1969 | Fisher | 172/781 |
| 3,983,945 | 10/1976 | Hart et al. | 172/795 |
| 4,015,669 | 4/1977 | Cole | 172/796 |
| 4,060,254 | 11/1977 | Ernst | 280/461 |
| 4,074,767 | 2/1978 | Cole | 172/795 X |
| 4,084,643 | 4/1978 | Easterling | 172/795 |
| 4,105,078 | 8/1978 | Gilbert | 172/741 X |
| 4,206,818 | 6/1980 | Beckham et al. | 172/781 |
| 4,237,986 | 12/1980 | Frisbee | 172/805 |
| 4,683,959 | 8/1987 | Clemens | 172/795 |

*Primary Examiner*—Terry Lee Melius
*Assistant Examiner*—Robert Pezzuto
*Attorney, Agent, or Firm*—Dennis C. Skarvan; William B. Heming

[57] ABSTRACT

An apparatus for coupling a blade assembly to a vehicle includes a circle assembly having a circle member. The apparatus further includes a plate having a passageway extending therethrough, the circle member being movable relative to the plate. The apparatus also includes a first wear strip positioned within the passageway, the first wear strip being located in contact with the circle member. The apparatus further includes a shim positioned within the passageway, the shim being located in contact with the wear strip. A method for coupling a blade assembly to a vehicle is also disclosed.

7 Claims, 9 Drawing Sheets

APPARATUS AND METHOD FOR COUPLING A BLADE ASSEMBLY TO A VEHICLE

BACKGROUND OF THE INVENTION

The present invention relates generally to a coupling mechanism, and more particularly to an apparatus and method for coupling a blade assembly to a vehicle, such as a tractor.

During a construction operation the displacement, distribution and leveling of material, such as dirt, is often required. A grader is typically used to perform the above mentioned work functions.

A grader includes a tractor and a grader group which is coupled to the tractor. The grader group includes a circle assembly and a tow bar assembly coupled to the tractor. The circle assembly is coupled to a blade assembly having a grader blade. Therefore, the blade assembly is coupled to the tractor through the circle assembly and the tow bar assembly.

The tow bar assembly includes a plate having a bottom surface. The bottom surface is precisely machined to provide a portion thereof that essentially defines a single plane surface. The tow bar assembly also includes a number of shoes secured to, and extending from, the single plane surface. The tow bar assembly further includes a number of shims interposed between the single plane surface and each shoe. Having all the shoes secured in the above described manner ensures that they extend a substantially equal distance from the plate.

The circle assembly includes a circle member. The circle assembly is coupled to the tow bar assembly by positioning a portion of the circle member between the plate and each shoe. In addition, upper wear strips are interposed between, and in contact with, the circle member and the plate. Lower wear strips are also provided. The lower wear strips are interposed between, and in contact with, the circle member and each shoe. Having the shoes secured to the single plane surface in the above described manner and then positioning a portion of the circle member between the plate and each shoe ensures that the circle assembly is appropriately positioned relative to the tow bar assembly.

The grader group also includes a motor linked to a gear. The gear meshes with gear teeth cut into the circle member. Actuation of the motor causes 20 the circle assembly, and thus the blade assembly, to rotate relative to the tow bar assembly. Rotation of the blade assembly allows an operator of the grader to locate the grader blade in an appropriate position relative to the tow bar assembly for performing various work functions.

During use of the grader, the grader group is moved over the ground by the tractor such that the grader blade engages the dirt to perform one of the aforementioned work functions. The shoes, the shims and the wear strips (i.e. the upper and lower wear strips) cooperate to maintain the circle assembly in an appropriate position relative to the tow bar assembly during work functions. The upper and lower wear strips also function as bearing surfaces to facilitate the rotation of the circle assembly relative to the tow bar assembly.

The engagement of the dirt by the grader blade causes the communication of a large force to the upper and lower wear strips. This force causes the upper and lower wear strips to erode. The rotation of the circle assembly also causes the upper and lower wear strips to erode. Erosion of the upper and lower wear strips causes the coupling between the tow bar assembly and the circle assembly to become loose beyond an acceptable tolerance. As the coupling becomes loose the circle assembly, and thus the grader blade, randomly move about relative to the tow bar assembly. Having the grader blade randomly moving about relative to the tow bar assembly inhibits accurate displacement, distribution or leveling of dirt. Therefore, the coupling between the tow bar assembly and the circle assembly must be tightened frequently as the upper and lower wear strips erode.

Tightening or adjusting the coupling between the tow bar assembly and the circle assembly has heretofore largely depended upon removal of one or more of the shims between the single plane surface and each shoe. However, this removal is work intensive, and thus increases the maintenance cost of the grader. An additional problem with the above described arrangement is that the machining process of the bottom surface of the plate is also work intensive. Therefore, the machining process adds to the manufacturing cost of the grader.

It would therefore be desirable to provide an apparatus and method for coupling a blade assembly to a vehicle that reduces the maintenance cost of a grader. It would also be desirable to provide an apparatus and method for coupling a blade assembly to a vehicle that provides a convenient mechanism for tightening or adjusting the coupling therebetween. It would still further be desirable to provide an apparatus and method for coupling a blade assembly to a vehicle that is inexpensive to manufacture.

SUMMARY OF THE INVENTION

The above and other objects, features and advantages of the present invention will become apparent from the following description and attached drawings.

In accordance with one embodiment of the present invention an apparatus for coupling a blade assembly to a vehicle is provided. The apparatus includes a circle assembly having a circle member, and a plate having a passageway extending therethrough, the circle member being movable relative to the plate. The apparatus also includes a first wear strip positioned within the passageway, the first wear strip being located in contact with the circle member. The apparatus further includes a shim positioned within the passageway, the shim being located in contact with the first wear strip.

In accordance with yet another embodiment of the present invention there is provided a method of coupling a blade assembly to a vehicle. The method includes the steps of (1) providing a plate having a passageway extending therethrough, (2) providing a circle assembly having a circle member, (3) positioning the circle assembly at a location below and adjacent to a lower end of the passageway, (4) positioning a first wear strip within the passageway so that the first wear strip is located in contact with the circle member, and (5) positioning a shim within the passageway so that the shim is located in contact with the first wear strip.

It is therefore an object of this invention to provide a new and useful apparatus and method for coupling a blade assembly to a vehicle.

It is another object of this invention to provide an improved apparatus and method for coupling a blade assembly to a vehicle.

It is still another object of this invention to provide an apparatus and method for coupling a blade assembly to a vehicle that reduces the maintenance cost of a grader.

It is yet another object of this invention to provide an apparatus and method for coupling a blade assembly to a vehicle that provides a convenient mechanism for tightening or adjusting the coupling therebetween.

It still another object of this invention to provide an apparatus and method for coupling a blade assembly to a vehicle that is inexpensive to manufacture.

The above and other objects, features, and advantages of the present invention will become apparent from the following description and the attached drawings.

DETAILED DESCRIPTION OF THE PREFERRED EMBODIMENTS

Figure 1:
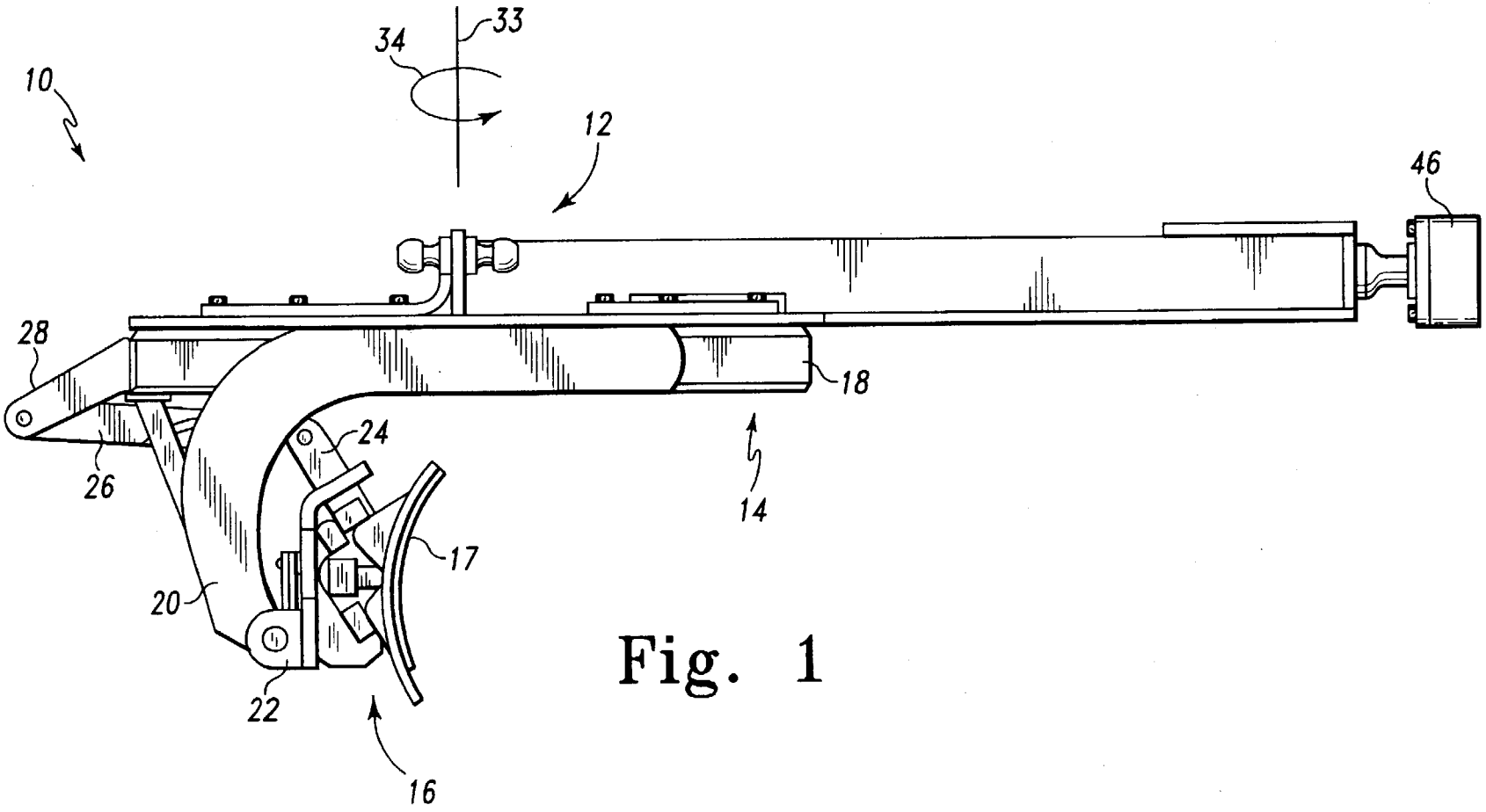
FIG. 1 is a side elevational view of a grader group which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a grader group 10 which incorporates the features of the present invention. Grader group 10 includes a tow bar assembly 12, a circle assembly 14 and a blade assembly 16. Tow bar assembly 12 is coupled to circle assembly 14. Circle assembly 14 is coupled to blade assembly 16. Blade assembly 16 has a grader blade 17 secured thereto. Grader group 10 is coupled to a vehicle (not shown), such as a tractor (not shown) in a well known manner via an adapter 46. During a grading operation, grader group 10 is moved over the ground to perform various grading functions. It should be understood that blade assembly 16 is coupled to the tractor (not shown) through circle assembly 14, tow bar assembly 12 and adapter 46.

Blade assembly 16 includes a first pivot flange 22 and a second pivot flange (not shown) fixed thereto. Blade assembly 16 also has a first tip flange 24 fixed thereto.

Circle assembly 14 includes a circle member 18, a first blade beam 20, a second blade beam (not shown) and a second tip flange 28. First blade beam 20 and second blade beam (not shown) are secured to circle member 18. First blade beam 20 is pivotally mounted in first pivot flange 22. In a similar fashion, second blade beam (not shown) is pivotally mounted in second pivot flange (not shown). First tip flange 24 is connected to a hydraulic cylinder 26. Hydraulic cylinder 26 is also connected to second tip flange 28. The above described arrangement couples blade assembly 16 to circle assembly 14.

Grader group 10 also includes a motor (not shown) linked to a gear (not shown). The gear meshes with teeth 30 (see FIG. 9) extending from an inside edge 31 (see FIG. 9) of circle member 18. Actuation of the motor causes circle member 18, and thus circle 20 assembly 14 and blade assembly 16, to rotate around axis 33 in the direction indicated by arrow 34. Actuation of the motor can also cause the rotation of circle member 18, and thus circle assembly 14 and blade assembly 16, to rotate around axis 33 in a direction opposite to the direction indicated by arrow 34. Thus actuation of the motor causes circle assembly 14 and blade assembly 16 to rotate relative to tow bar assembly 12 in the aforementioned directions. It should be appreciated that rotation of the blade assembly 16 allows an operator to locate grader blade 17 in an appropriate position relative to the tow bar assembly 12 for performing various work functions.

Figure 2:
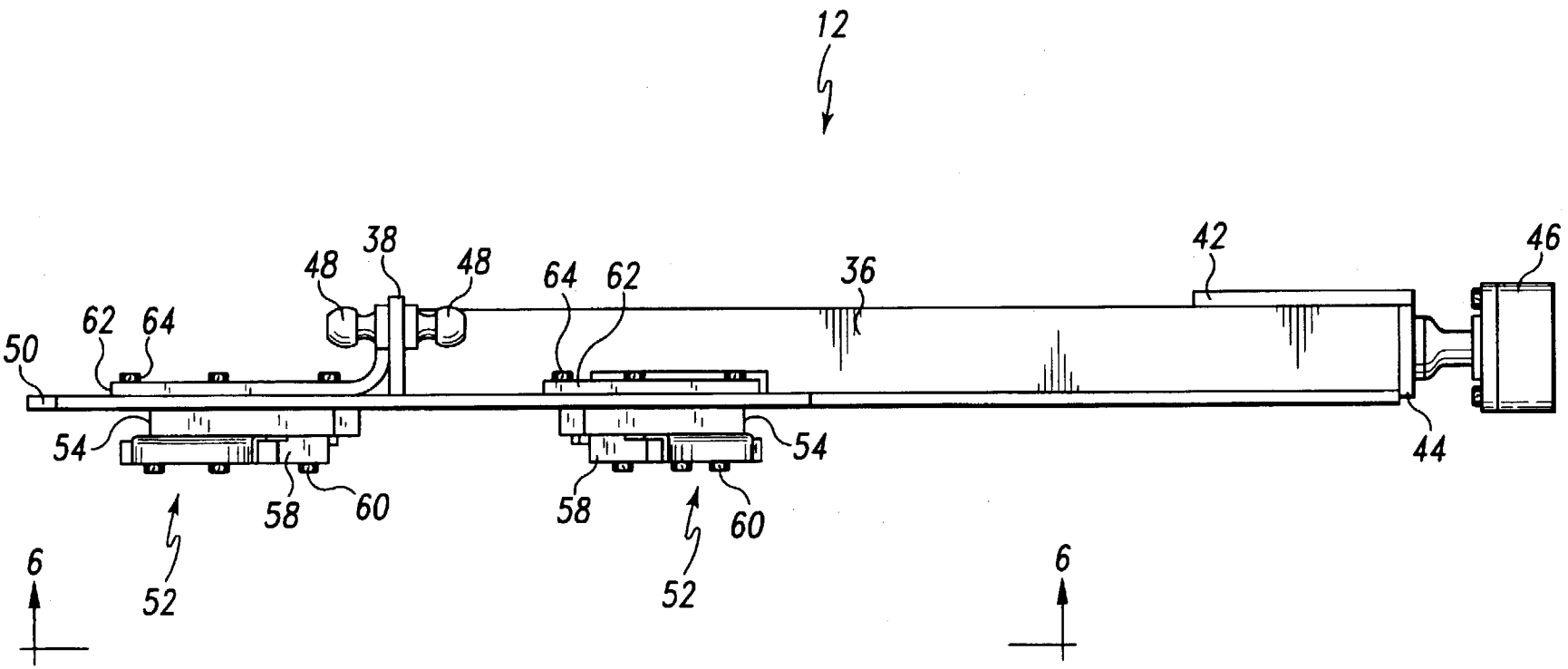
FIG. 2 is a side elevational view of the tow bar assembly shown in FIG. 1, with the circle assembly and the blade assembly removed for clarity of description.
Figure 3:
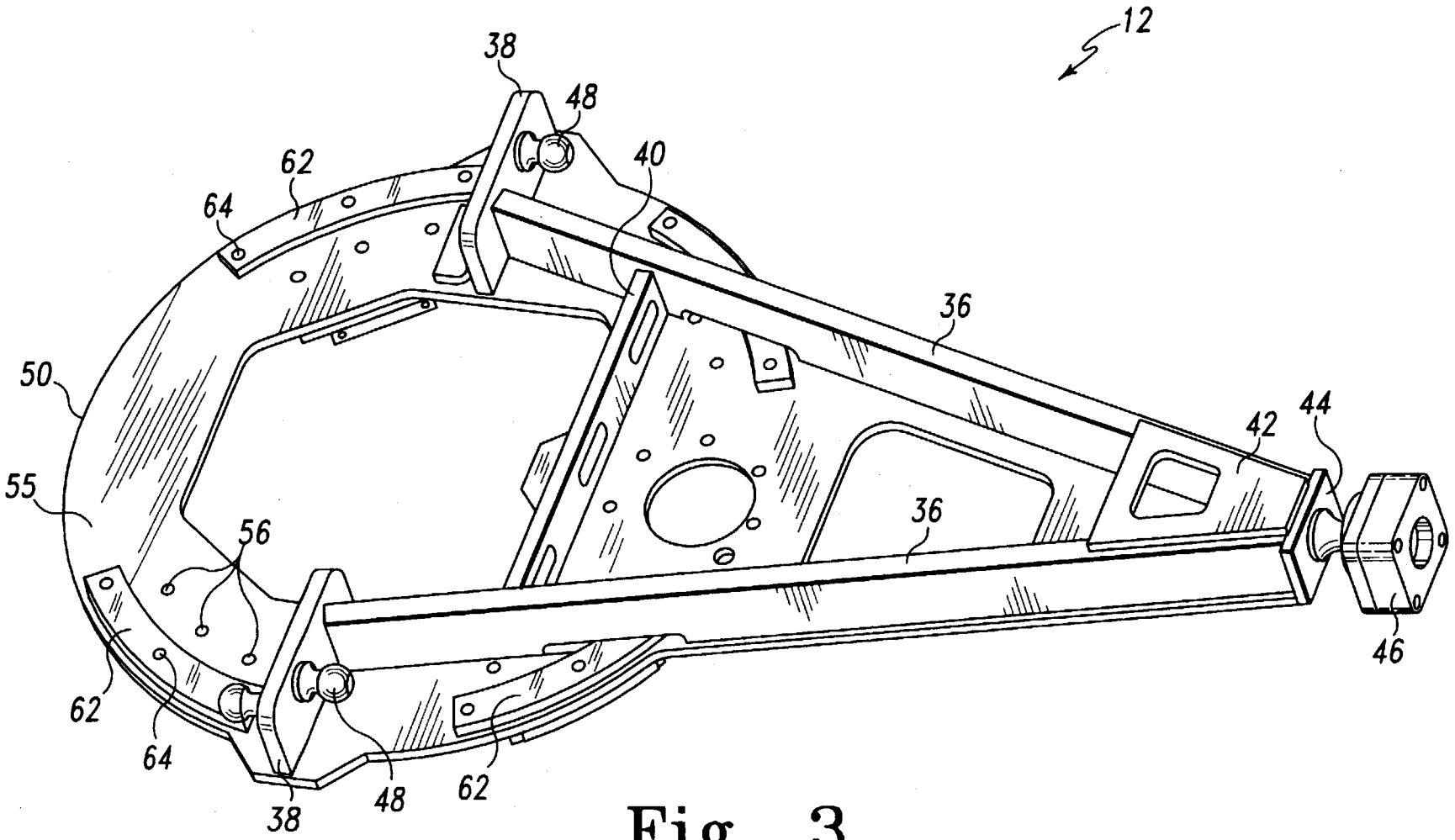
FIG. 3 is a perspective view of the tow bar assembly shown in FIG. 2.

As shown in FIGS. 2 and 3, tow bar assembly 12 includes a pair of draw bars 36, a cross bar 40, a top plate 42 and an end plate 44. Tow bar assembly 12 also includes a plate 50 having a bottom surface 53 (see FIGS. 6 and 7) and a top surface 55. Plate 50 also has a number of passageways 51 (see FIGS. 6 and 7) extending therethrough. Draw bars 36 are positioned on, and secured to, plate 50 to form a V-shaped configuration. Top plate 42 is secured to draw bars 36 adjacent to each end thereof. End plate 44 is secured to the ends of draw bars 36, adjacent to top plate 42 as shown in FIG. 3. Adapter 46 is secured to end plate 44. Cross bar 40 is interposed between, and connected to draw bars 36. Cross bar 40 is also connected to plate 50. An end of each draw bar 36, opposite to the one secured to end plate 44, is secured to a back bar 38. Each back bar 38 has a number of cylinder balls 48 extending therefrom.

Figure 4:
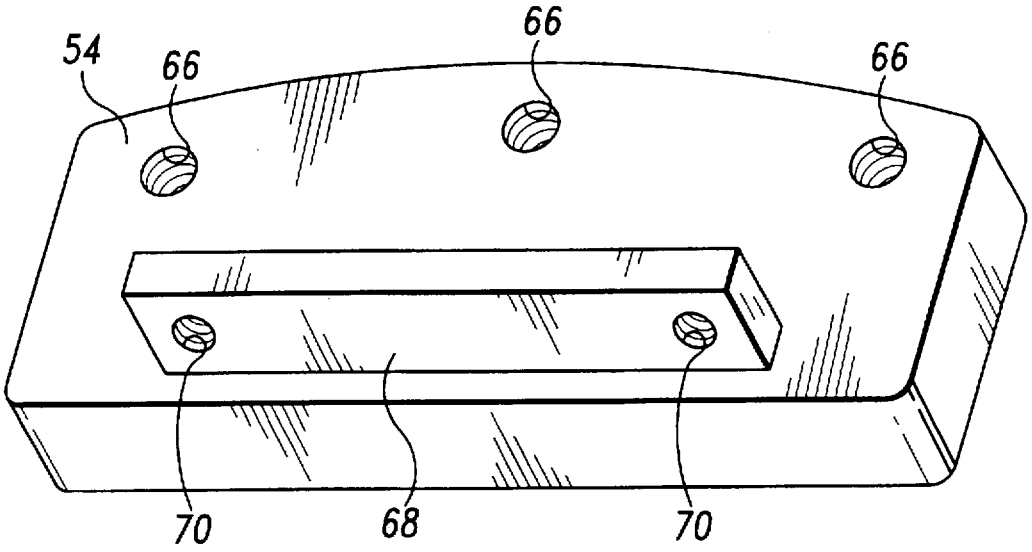
FIG. 4 is a perspective view of a base of the coupling assembly of FIG. 2.

Draw bar assembly 12 further includes a number of coupling assemblies 52 secured to plate 50. Coupling assembly 52 includes a base 54, a shoe 58 and a number of holders 62. As shown in FIG.4, base 54 has a number of threaded apertures 66 defined therein. It should be understood that threaded apertures 66 do not extend all the way through base 54. Base 54 also includes a number of bolt holes (not shown) which are defined in the underside of the base for receiving bolts 56 (see FIG. 3). The bolt holes are used to secure base 54 to bottom surface 53 of plate 50. Base 54 further includes an adjustment support 68 extending therefrom. Adjustment support 68 has a pair of internally threaded holes 70 extending therethrough.

Figure 5:
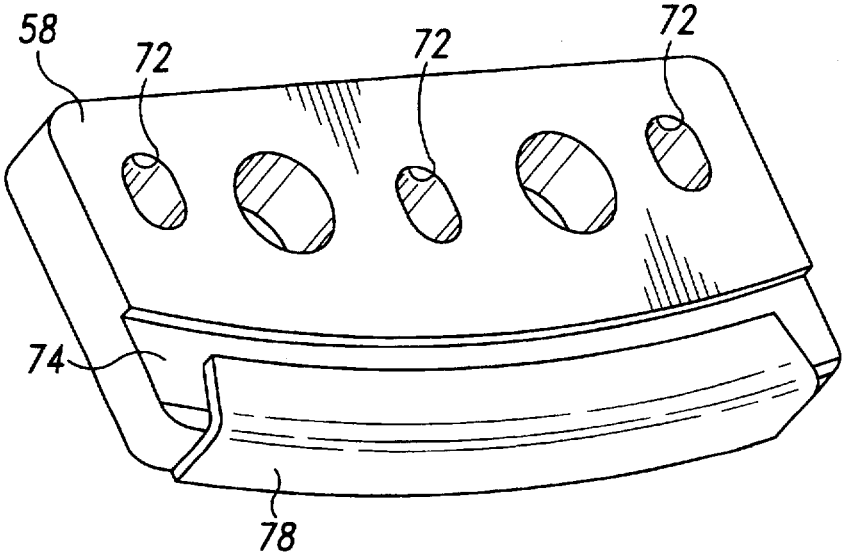
FIG. 5 is a perspective view of a shoe of the coupling assembly of FIG. 2, with the shoe having a lower wear strip secured thereto.
Figure 8:
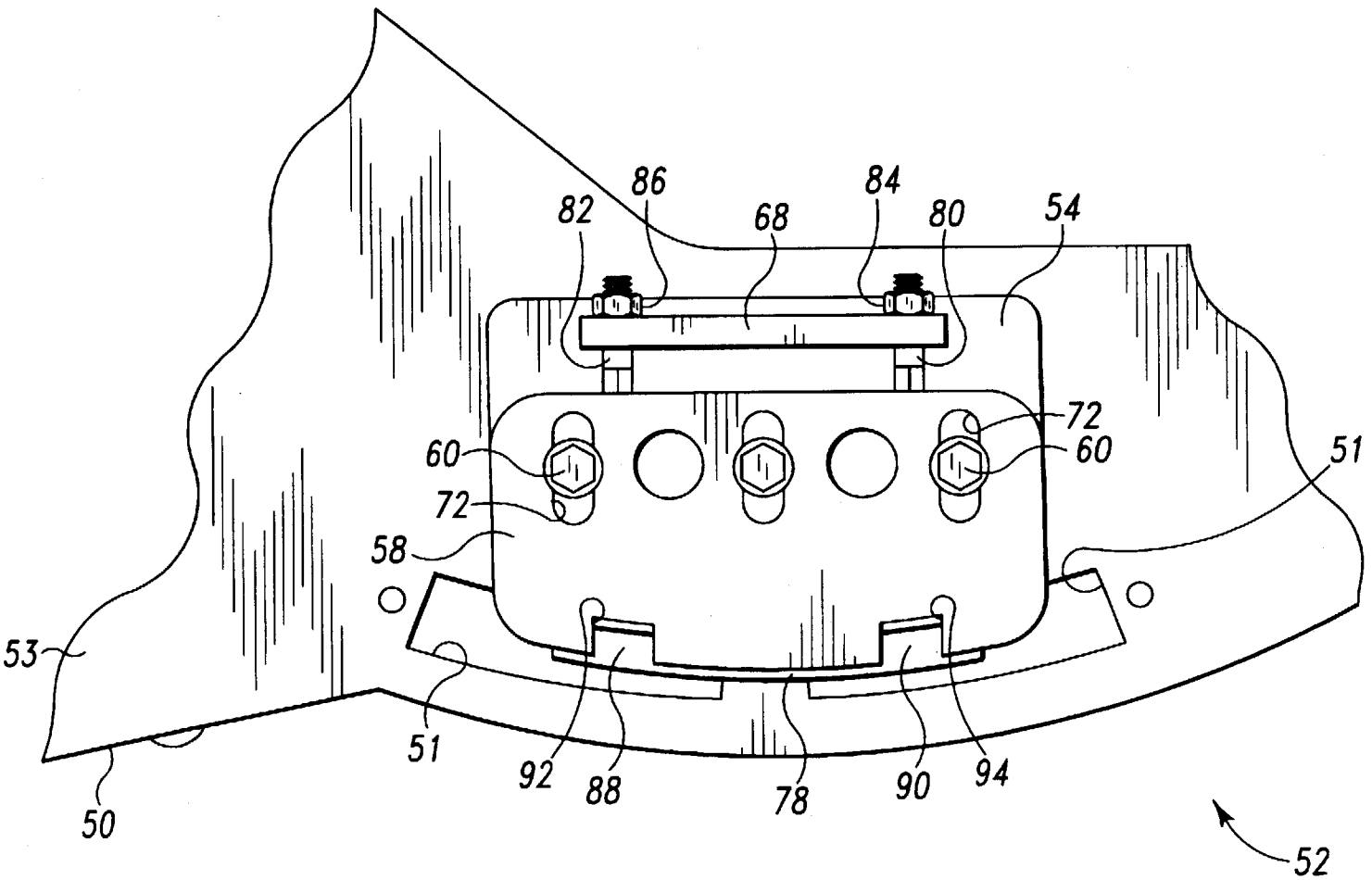
FIG. 8 is an enlarged view of one of the adjustment assemblies shown in FIG. 7, with the first and second externally threaded screws shown engaged with the first and second nuts, respectively, and with only a fragment of the plate shown for clarity of description.

As shown in FIG. 5, shoe 58 has a number of slots 72 extending therethrough, and a recessed surface 74 formed thereon. Shoe 58 also includes a lower wear strip 78 secured thereto, and located in contact with recessed area 74. As shown in FIG. 8, lower wear strip 78 includes a first tab 88 and a second tab 90. Lower wear strip 78 is further located on shoe 58 such that first tab 88 extends into a first notch 92 defined in shoe 58. Lower wear strip 78 is also located on shoe 58 such that second tab 90 extends into a second notch 94 defined in shoe 58. It should be understood that having first tab 88 and second tab 90 extending into first notch 92 and second notch 94, respectively, prevents lower wear strip 78 from moving relative to shoe 58.

Figure 10:
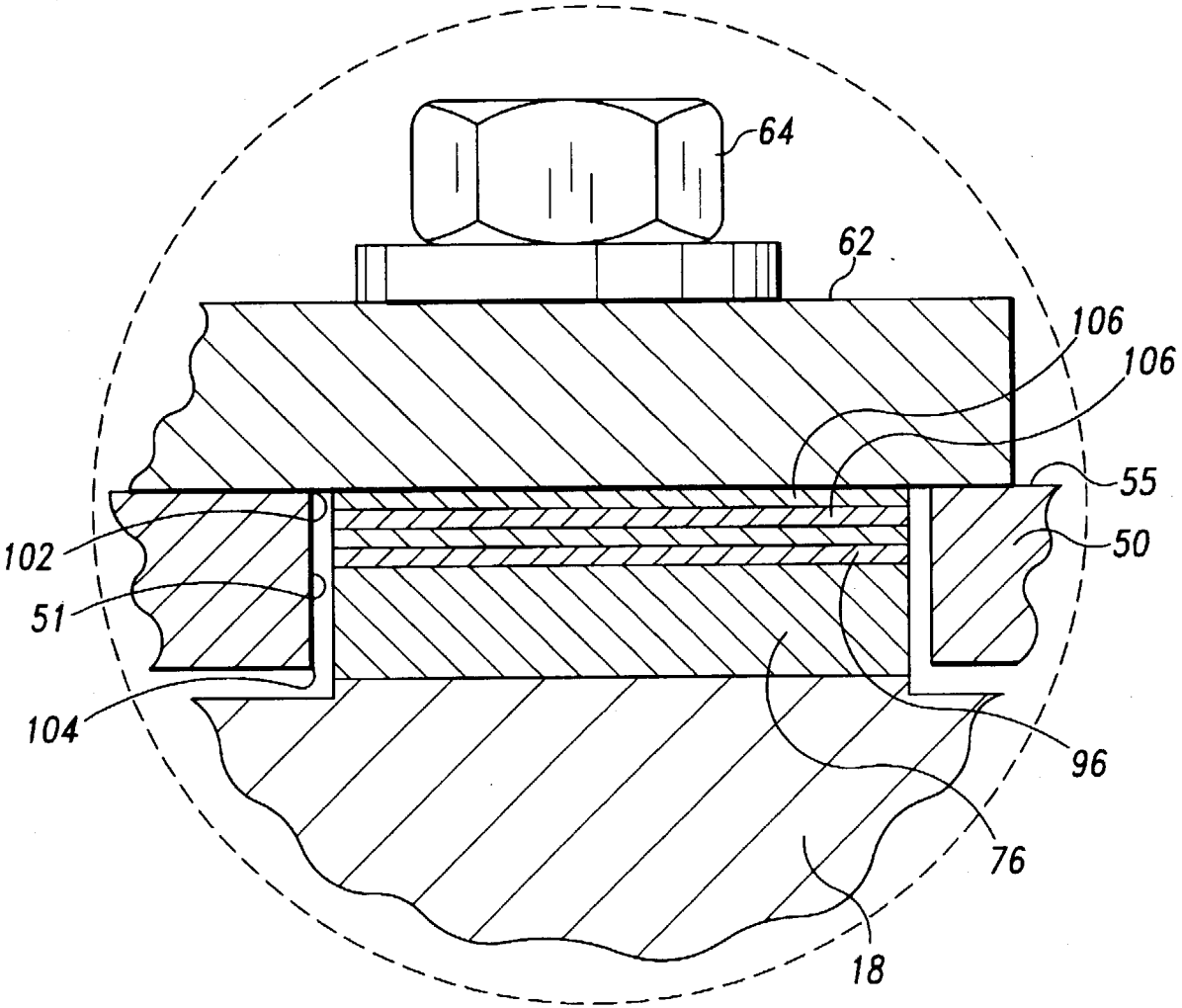
FIG. 10 is an enlarged view of a portion of FIG. 9 which is encircled and indicated as FIG. 10.

Referring again to FIGS. 2 and 3, holders 62 are secured to top surface 55 of plate 50 with bolts 64. As shown in FIG. 10, holders 62 are located on top surface 55 such that holders 62 are positioned over a first end 102 of passageway 51.

Figure 6:
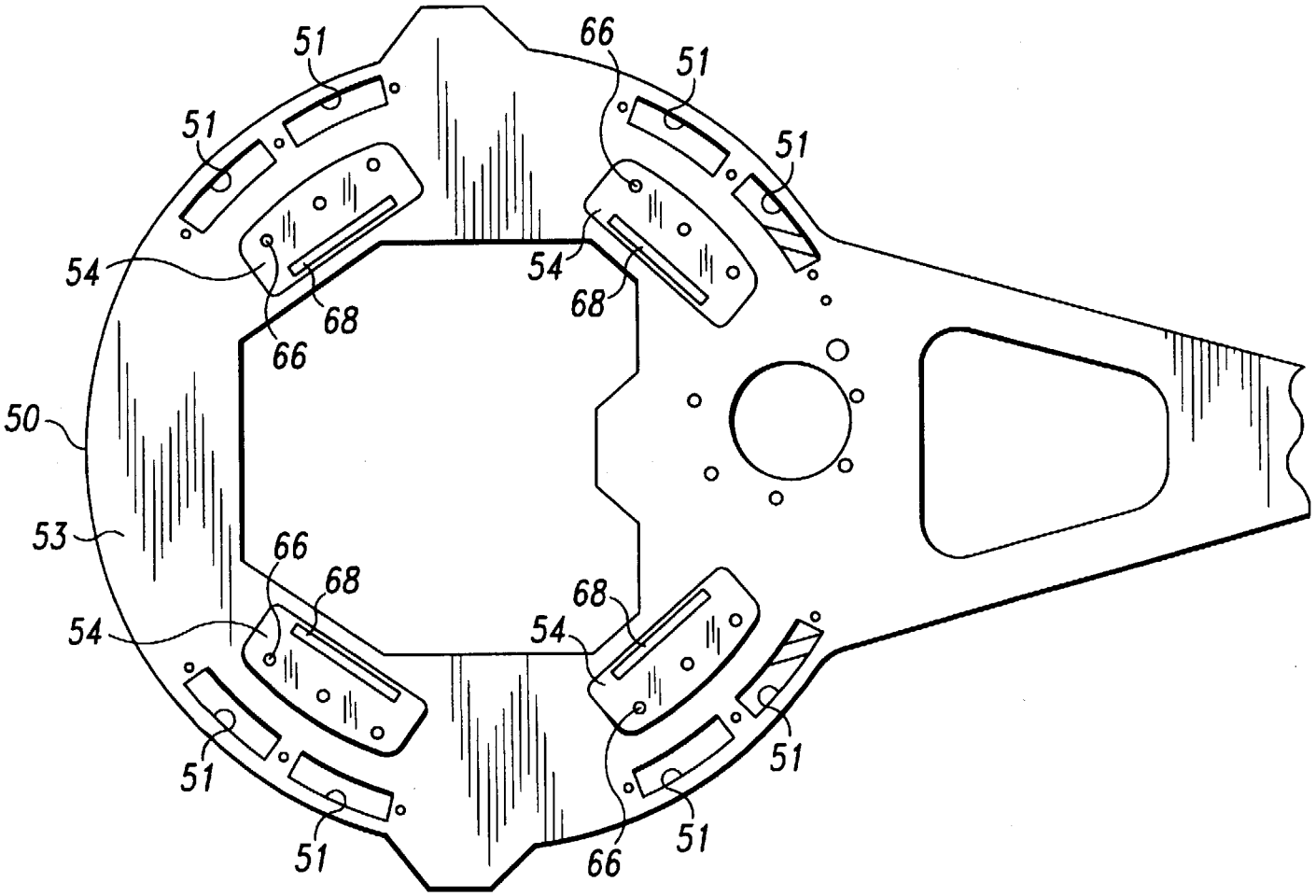
FIG. 6 is a fragmentary elevational view of the tow bar assembly taken along line 6—6 of FIG. 2 as viewed in the direction of the arrows, with the shoes and the holders removed for clarity of description.
Figure 9:
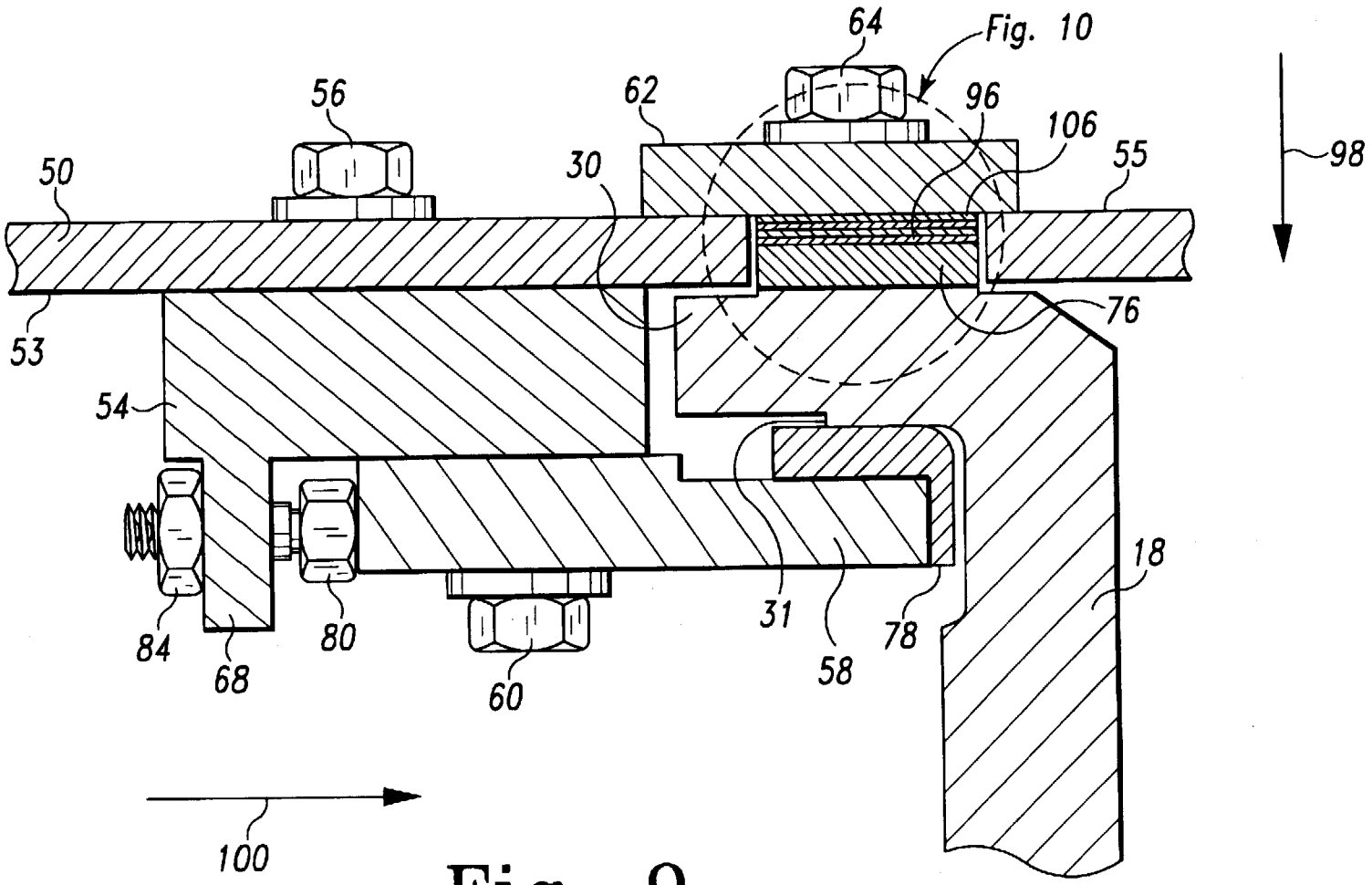
FIG. 9 is a fragmentary cross sectional view taken through the plate, the circle member and one of the adjustment assemblies when the circle assembly is coupled to the tow bar assembly.

As shown in FIG. 6, each base 54 is secured to bottom surface 53 of plate 50 with bolts 56 (see FIGS. 3 and 9). However, each base 54 can also be secured to bottom surface 53 by welding. Each base 54 is located on bottom surface 53 adjacent to passageways 51. It should be understood that each base 54 is secured to plate 50 such that adjustment support 68 extends away from bottom surface 53.

Figure 7:
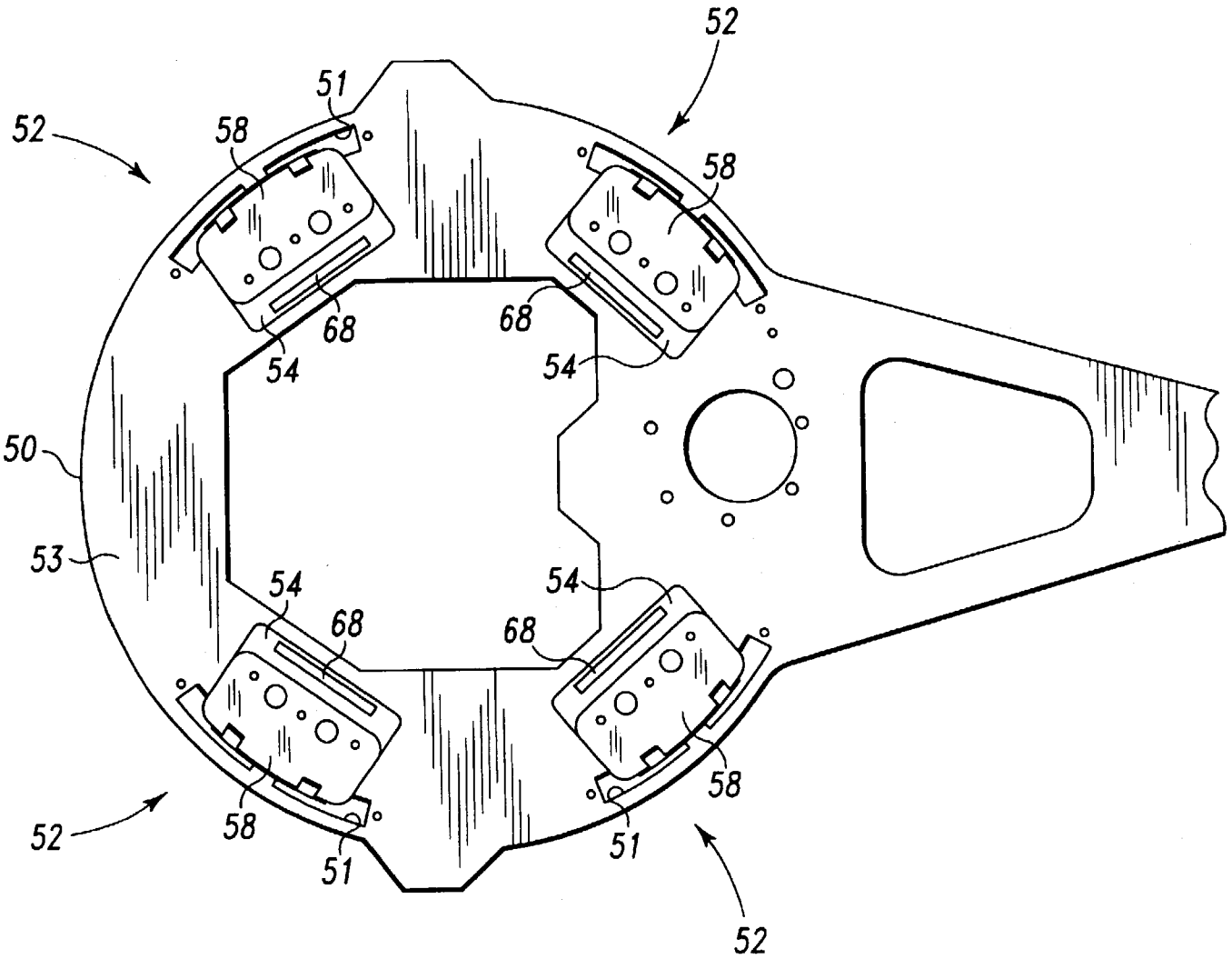
FIG. 7 is a view similar to that shown in FIG. 6, but showing a shoe secured to each base.

Referring now to FIG. 7, a shoe 58 is positioned on each base 54. Shoe 58 is positioned such that slots 72 (see FIG. 5) of each shoe 58 and threaded apertures 66 (see FIG. 4) of each base 54 align. Each shoe 58 is further positioned on each base 54 such that recessed area 74 of each shoe 58 and a portion of lower wear strip 78 face toward passageway 51.

As shown in FIG. 8, a bolt 60 is positioned in slot 72 such that bolt 60 extends into threaded aperture 66 (see FIG. 4) of base 54. Bolt 60 is rotated relative to base 54 such that bolt 60 meshingly engages threaded aperture 66. The meshing engagement causes bolt 60 to move toward shoe 58 and base 54, thereby securing shoe 58 and base 54 together. It should be understood that shoe 58 does not move relative to base 54 when bolt 60 has been rotated relative to base 54 in the aforementioned manner.

A first externally threaded screw 80 is screwed through internally threaded hole 70 (see FIG. 4) such that an end of first externally threaded screw 80 contacts shoe 58. A first nut 84 is screwed onto an end of first externally threaded screw 80 opposite to the end contacting shoe 58. A second externally threaded screw 82 is screwed through the other internally threaded hole 70 (see FIG. 4) such that an end of second externally threaded screw 82 contacts shoe 58. A second nut 86 is screwed onto an end of second externally threaded screw 82 opposite to the end contacting shoe 58.

Now referring to FIGS. 9 and 10, there is shown a portion of circle member 18 positioned below a second end 104 of passageway 51. An upper wear strip 76 is positioned within passageway 51. Upper wear strip 76 contacts circle member 18. A shim 96 is positioned within passageway 51 such that shim 96 is in contact with upper wear strip 76. A number of supplemental shims 106 are also positioned within passageway 51.

Holder 62 is positioned over first end 102 of passageway 51 and secured to top surface 55 of plate 50 with bolt 64 as discussed above. Shim 96 and upper wear strip 76 are interposed between circle member 18 and holder 62. Shoe 58 having lower wear strip 78 secured thereto is positioned relative to upper wear strip 76 such that circle member 18 is interposed between upper wear strip 76 and lower wear strip 78. As previously described, base 54 is secured to bottom surface 53 of plate 50 with bolt 56 such that base 54 is interposed between shoe 58 and plate 50.

Shoe 58 is moved relative to base 54 in a direction indicated by arrow 100 in the following manner. Each bolt 60 (note that only one bolt 60 is shown in FIG. 9) is rotated in a direction that causes bolt 60 to move away from shoe 58 and base 54. Moving bolt 60 away from shoe 58 and base 54 allows shoe 58 to move relative to base 54.

First nut 84 is unscrewed from first externally threaded screw 80. First externally threaded screw 80 is then rotated relative to adjustment member 68 such that first externally threaded screw 80 moves toward shoe 58. The above described procedure relating to first externally threaded screw 80 is repeated for second externally threaded screw 82. Movement of first externally threaded screw 80 and second externally threaded screw 82 in the direction described above causes shoe 58 to move in the direction indicated by arrow 100.

Once shoe 58, and therefore lower wear strip 78, are moved in the direction indicated by arrow 100 to an appropriate position, first nut 84 is screwed onto first externally threaded screw 80, and second nut 86 (see FIG. 8) is screwed onto second externally threaded screw 82, thereby locking first externally threaded screw 80 and second externally threaded screw 82 into position relative to adjustment support 68. Each bolt 60 is retightened by rotating in a direction that causes bolt 60 to move toward shoe 58 and base 54 until shoe 58 is locked into position relative to base 54. It should be understood that the above described procedure allows for the horizontal adjustment of lower wear strip 78 relative to plate 50. The horizontal adjustment of lower wear strip 78 in the direction indicated by arrow tightens the coupling between tow bar assembly 12 and circle assembly 14.

Shoe 58 can be moved relative to base 54 in a direction opposite to the direction indicated by arrow 100 by following a similar procedure as described above except that first externally threaded screw 80 and second externally threaded screw 82 are rotated relative to adjustment member 68 such that first externally threaded screw 80 and second externally threaded screw 82 move away from shoe 58. Shoe 58 is then moved toward first externally threaded screw 80 and second externally threaded screw 82 with tool, such as a hammer, until shoe 58 contacts first externally threaded screw 80 and second externally threaded screw 82. First externally threaded screw 80 and second externally threaded screw 82 are then locked in place as described above, and bolts 60 retightened.

Vertical movement of upper wear strip 76 relative to plate 50 in the direction indicated by arrow 98 is accomplished in the following manner. Unscrewing bolt 64 and removing holder 62 so as to expose passage way 51. Thereafter, one or more supplemental shims 106 are positioned within passageway 51. Then, holder 62 is resecured over upper end 102 of passageway 51 so that supplemental shims 106 and upper wear strip 76 are interposed between circle member 18 and holder 62. It should be understood that resecuring holder 62 over upper end 102 of passageway 51 while having one or more supplemental shims 106 positioned within passageway 51 forces upper wear strip 76 in the vertical direction indicated by arrow 98. The vertical movement of upper wear strip 76 in the direction indicated by arrow 98 tightens the coupling between tow bar assembly 12 and circle assembly 14.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. Apparatus for adjustment of a circle assembly on a vehicle for rotational movement, comprising:

a plate having a passageway extending therethrough and top and bottom surfaces;

a circle assembly rotatable relative to said plate;

a base secured to the bottom surface of said plate adjacent said circle assembly;

a shoe secured to and movable relative to said base in a direction toward said circle assembly;

a lower wear strip secured to said shoe and positioned between said shoe and said circle assembly;

an upper wear strip positioned in said plate passageway and in contact with said circle assembly;

a holder positioned over said passageway and secured to said top surface of said plate; and a shim positioned in said plate passageway between said holder and said upper wear strip.

2. The apparatus of claim 1, wherein said base is secured to said plate by a bolt at the top surface of said plate.

3. The apparatus of claim 2, wherein said shoe is secured to said base by a bolt.

4. The apparatus of claim 1, wherein movement of said shoe relative to said base provides horizontal adjustment of the lower wear strip relative to said plate and said circle assembly.

5. The apparatus of claim 1, wherein adding an additional shim in said plate passageway provides vertical adjustment of said upper wear strip relative to said plate and said circle assembly.

6. The apparatus of claim 1, further comprising:

an adjustment support extending from said base, said adjustment support includes an internally threaded hole defined therein; and an externally threaded screw which is meshingly engaged with said internally threaded hole defined in said adjustment support.

7. The apparatus of claim 6, wherein:

rotation of said externally threaded screw relative to said base causes movement of said shoe relative to said base.

* * * * *